US005984040A

United States Patent [19]

Lee

[11] Patent Number: 5,984,040

[45] Date of Patent: Nov. 16, 1999

[54] PEDAL LOCKING DEVICE FOR A LOADER

[75] Inventor: Seung Keun Lee, Incheon, Rep. of Korea

[73] Assignee: Daewoo Heavy Industries Ltd., Incheon, Rep. of Korea

[21] Appl. No.: 08/929,084

[22] Filed: Sep. 15, 1997

[30] Foreign Application Priority Data

Sep. 16, 1996 [KR] Rep. of Korea ..... 96-40180

[51] Int. Cl.[6] ..... B60D 1/28; B60K 28/12; B60R 21/00

[52] U.S. Cl. ..... 180/271; 180/286; 180/269

[58] Field of Search ..... 180/89.12, 271, 180/272, 286, 269; 280/748; 74/529

[56] References Cited

U.S. PATENT DOCUMENTS

| | | | |
|---|---|---|---|
| 4,318,571 | 3/1982 | Vize | 303/71 |
| 4,388,980 | 6/1983 | Vig et al. | 180/271 |
| 4,391,344 | 7/1983 | Weber et al. | 180/271 |
| 4,397,371 | 8/1983 | Lynnes | 180/271 |
| 5,050,700 | 9/1991 | Kim | 180/268 |
| 5,383,532 | 1/1995 | Shonai et al. | 180/269 |

*Primary Examiner*—J. J. Swann
*Assistant Examiner*—Christopher Bottorff

[57] ABSTRACT

A loader includes a seat bar swingable between a lowered, operator protective position and a raised, non-protective position. A pedal is movable between an operative position and a neutral position and has a plate member with a slot opened at it's top end. A pedal side crank is provided adjacent the pedal for rotation between a locking position and an unlocking position. Normally biased into the locking position, the pedal side crank has a lug member and is operatively coupled to the seat bar by virtue of a connecting rod and a seat bar side crank. Movement into the raised position of the seat bar causes the lug member of the pedal side crank to engage with the slot of the plate member of the pedal, thus locking the pedal in the neutral position.

12 Claims, 5 Drawing Sheets

PEDAL LOCKING DEVICE FOR A LOADER

FIELD OF THE INVENTION

The present invention relates generally to loaders and more specifically to a loader pedal locking device capable of preventing inadvertent up/down movement of a boom and unwanted tilting movement of a bucket by way of having a foot pedal locked in its neutral position when a seat bar is not lowered into an operator restraint position.

DESCRIPTION OF THE PRIOR ART

Typical loaders include a vehicle body and a canopy mounted on the body for enclosing an operator's seat. The canopy is provided with a front opening that allows the operator to gain access to the operator's seat. Some types of loaders are expected to run over rough terrain, make sudden stops and turns and are subject to sudden tilting and lurching. A skid steer loader is a type of loader in which the operator often encounters rough ride conditions.

For the operator to be protected safely under the rough ride conditions, need exists for safety devices that can restrain the body of the operator to the seat. The conventional safety devices include a seat bar pivotally mounted to the opposite side walls of the canopy for swing movement about a pivot axis between a raised position and a lowered position. The seat, bar remaining in the raised position permits the operator to take or leave the seat through the front opening of the canopy. The operator would be restrained between the seat and the seat bar in case where the seat bar assumes the lowered position. This will keep the operator adhered to the seat even under the rough ride conditions, thus removing the possibility of being thrown from the seat due to the sudden movement of the loader.

There may be however such an instance that a pedal is mistakenly depressed with the seat bar in the raised position, subjecting the boom and/or bucket to sudden movement and hence putting the operator in danger. As a solution to this problem, U.S. Pat. No. 4,388,980 dated Jun. 21, 1983 discloses a loader having a locking assembly which is engaged with a control link when an operator restraint member is in it's disengaged position but is disengaged from the control link when the restraint member is in it's engaged position. The control link serves to, when a pedal is depressed, shift a boom control valve and a bucket control valve from their neutral position into operative positions. Lifting up the restraint member to lock the control link in it's neutral position causes the pedal to be also locked, making it possible to avoid any inadvertent actuation of the boom and the bucket.

The locking assembly taught in the '980 patent appears not to be totally satisfactory in view of the following aspects. First of all, since the locking operation can be effected only when the control link and the pedal are in the neutral position, the control link may be left unlocked if the operator lifts up the restraint member while depressing the pedal in error. Secondly, a significant part of the locking assembly is hidden under the vehicle body and therefore deteriorates it's visibility and accessibility for maintenance. A third drawback is that the locking assembly is highly susceptible of trouble because of it's exposure to mud, sand and the like material on the ground.

SUMMARY OF THE INVENTION

With the foregoing problems in mind, it is therefore an object of the invention to provide a loader that can automatically lock a foot pedal in it's neutral position whenever a seat bar is lifted up.

Another object of the invention is to provide a pedal locking device for a loader which can forcibly return a pedal into it's neutral position and then have it locked in that position.

A further object of the invention is to provide a pedal locking device for a loader that can ease maintenance thereof, has a reduced possibility of trouble and permits ready confirmation of trouble, if occured.

In accordance with the invention, there is provided a loader comprising a seat bar swingable between a lowered position for securing the operator in place and a raised position for allowing the operator to enter or leave the loader. A power operated working implement is controlled by a hydraulic control valve unit which maintains operative association with a pedal. The pedal is movable between an operative position for causing the control valve unit to feed the fluid under pressure to the working implement and a neutral position for having the control valve unit interrupt the fluid delivery to the working implement. The pedal has a plate member with a slot opened at it's top end. A pedal side crank is provided in proximity to the pedal for rotation between a locking position and an unlocking position and is normally biased into the locking position. The pedal side crank has a lug member engageable with the slot of the plate member and is operatively coupled to the seat bar by virtue of a connecting rod and a seat bar side crank. Movement into the raised position of the seat bar causes the lug member of the pedal side crank to engage with the slot of the plate member, thus locking the pedal in the neutral position.

BRIEF DESCRIPTION OF THE DRAWINGS

The above and other objects, features, advantages of the invention will become apparent from a review of the following detailed description of the preferred embodiment taken in conjunction with the accompanying drawings, in which.

DETAILED DESCRIPTION OF THE PREFERRED EMBODIMENT

Figure 1:
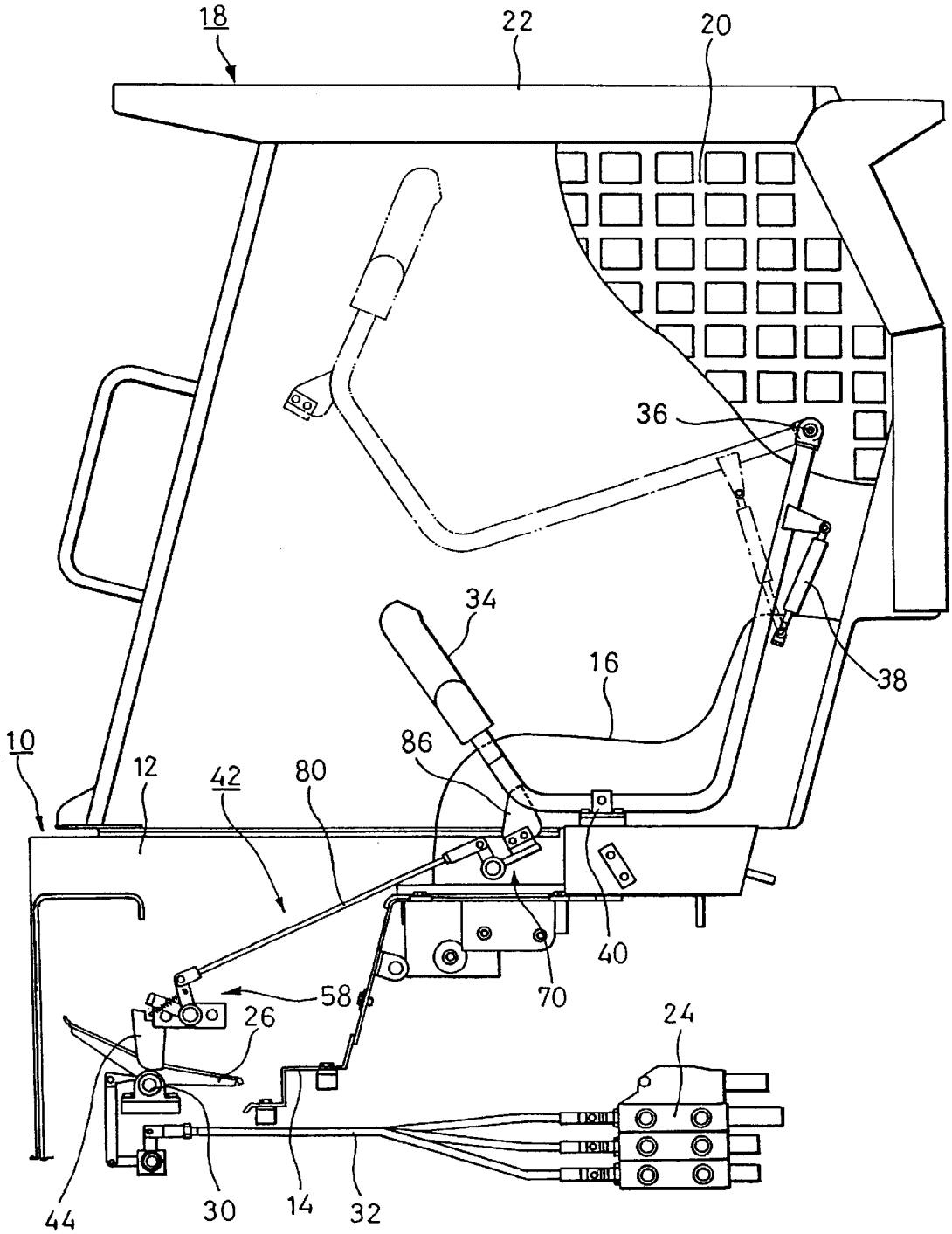
FIG. 1 is a side elevational view showing a skid steer loader employing a pedal locking device in accordance with the invention, with portions thereof removed for clarity.
Figure 2:
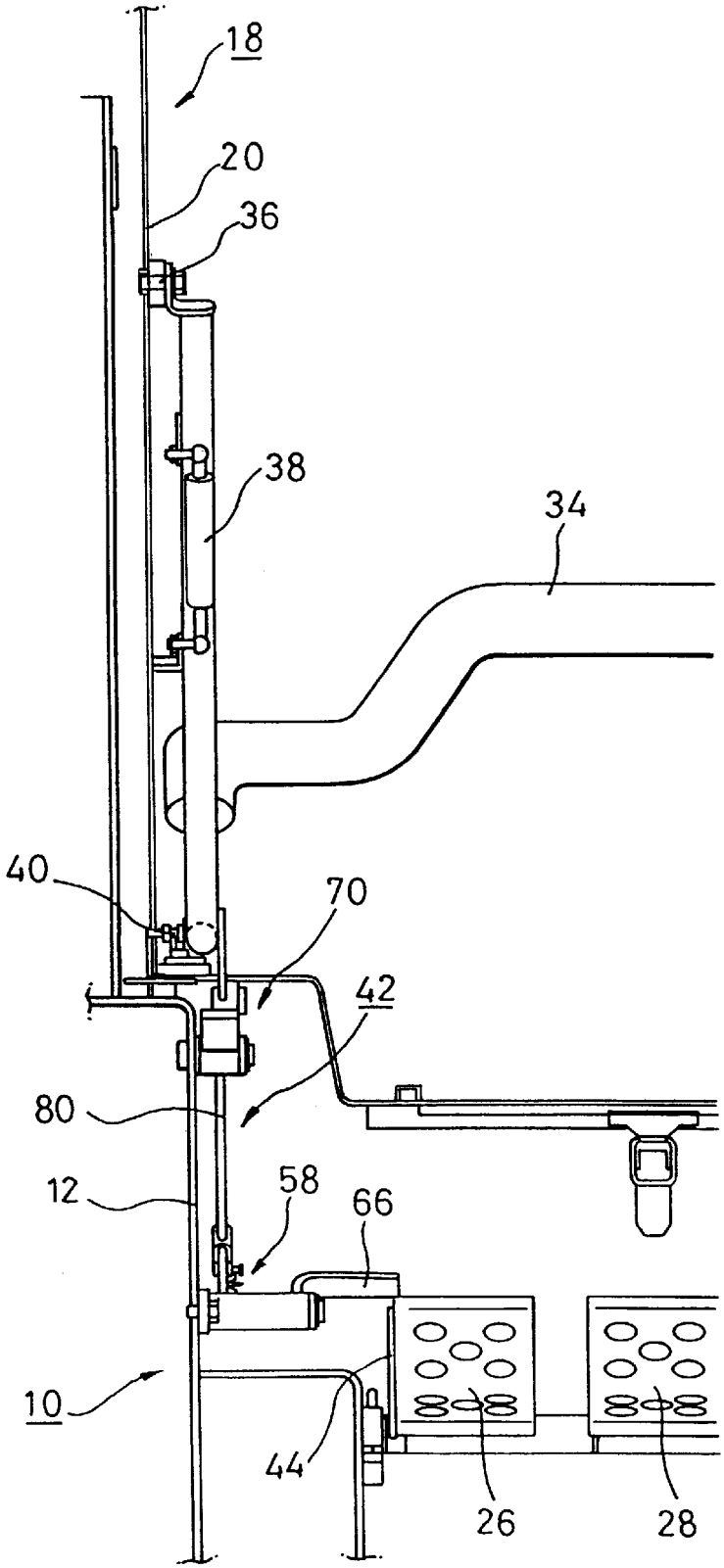
FIG. 2 is a partially enlarged rear view of the skid steer loader, illustrating the structural relationship of a seat bar, a pedal locking device and a foot pedal with respect to a vehicle body and a canopy.

Referring now to FIGS. 1 and 2, it will be noted that a skid steer loader is partially illustrated by way of example which employs a pedal locking device according to the invention. The skid steer loader includes a vehicle body 10 having a side frame 12 and a hood frame 14. An operator's seat 16 is mounted on the hood frame 14, while a canopy 18 is attached to the side frame 12 to enclose the operator's seat 16. The canopy 18 consists of a side wall 20 and a roof 22 and has a front opening for operator entrance and egress.

Provided under the hood frame 14 of the body 10 is a hydraulic control valve unit 24 that serves to control the fluid flow to a variety of hydraulic working implements, e.g., a boom cylinder and a bucket cylinder, both of which are not shown in the drawings. In front of the hood frame 14, such foot pedals as a boom pedal 26 and a bucket pedal 28 are provided for tilting movement about a pivot axis 30. As clearly indicated in FIG. 1, the boom pedal 26 is operatively associated with the hydraulic control valve unit 24 via control links 32. The boom pedal 26 may be subject to pivotal movement from a neutral position either into a first operative position for lifting up the boom and a second operative position for lowering down the boom. The bucket pedal 28 can be operated in a similar way.

The skid steer loader also includes a seat bar 34 mounted to the side wall 20 of the canopy 18 for swinging movement about a pivot axis 36 between a lowered, operator protective position as indicated in solid lines and a raised, non-protective position as shown in phantom lines. The seat bar 34 will secure the operator to the seat 16, when in the lowered position, to protect the operator under rough ride conditions, but will allow the operator to leave the seat 16 when in the raised position. At a portion adjacent the pivot axis 36, the seat bar 34 is supported on the vehicle body 10 by a gas spring 38 such that it can have a tendency to constantly remain in one of the lowered position and the raised position. Moreover, on the side frame 12 of the vehicle body 10, there is provided a latch 40 that functions to releasably secure the seat bar 34 in the lowered position.

Figure 3:
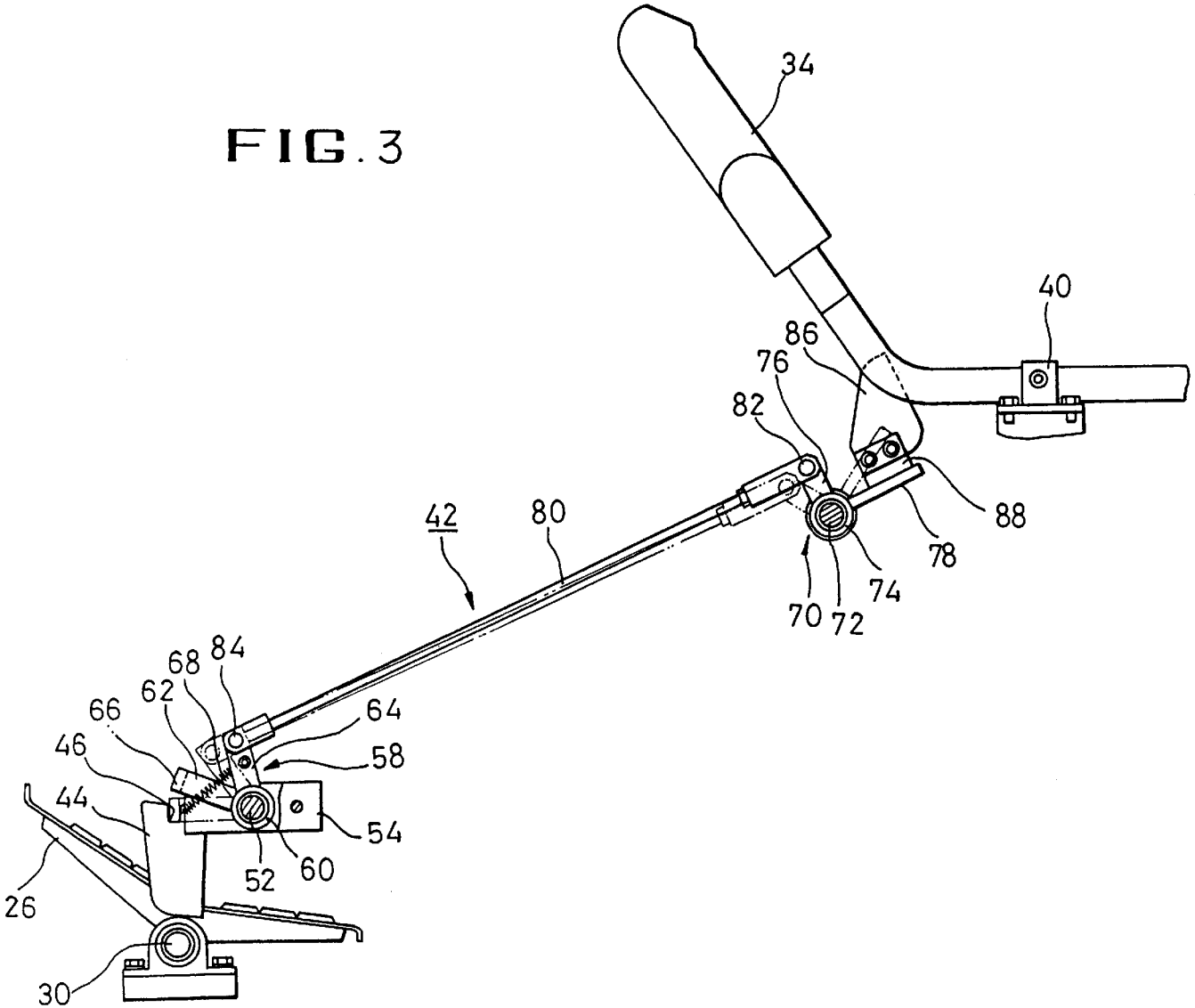
FIG. 3 is an enlarged view of the pedal locking device in accordance with the invention, with solid lines indicating the pedal released and phantom lines showing the pedal locked in it's neutral position.
Figure 4:
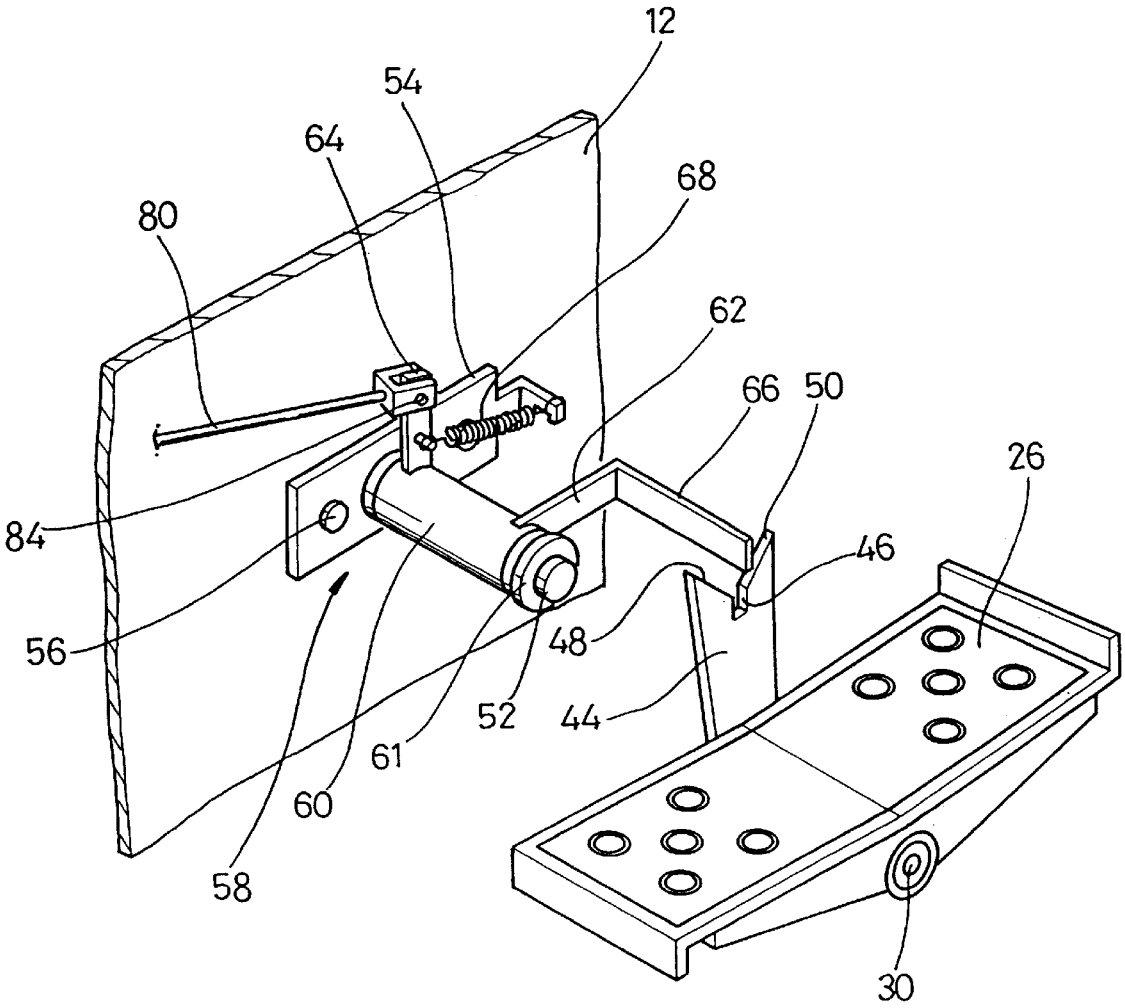
FIG. 4 is a perspective view best illustrating the pedal and the pedal locking device in accordance with the invention.

With reference to FIGS. 3 and 4, the pedal locking device 42 includes an upright plate member 44 attached to the flank side of the boom pedal 26 as by welding or other suitable fastener means for unitary pivotal movement with the boom pedal 26 about the pivot axis 30. The plate member 44 has a vertically extending slot 46 opened at it's top extremity and first and second ramps 48, 50 diverging from the open end of the slot 46. The height of the respective ramp 48 or 50 is adapted to gradually increase as the ramp goes away from the slot 46.

A bracket 54 with a pivot shaft 52 is fixedly secured as by a bolt 56 to the side frame 12 of the vehicle body 10 in proximity to the boom pedal 26. The pivot shaft 52 serves to rotatably support a pedal side crank 58 in a manner that the crank 58 can be rotated between a pedal locking position for locking the boom pedal 26 in it's neutral position and a pedal unlocking position for allowing the boom pedal 26 to be rotated into it's first and second operative positions. The pedal side crank 58 is provided with a collar 60 which remains fitted to the pivot shaft 52 by means of a retainer ring 61. The pedal side crank 58 further has front and rear arms 62, 64 extending radially outwardly from the collar 60 in a spaced apart relationship with each other.

Integrally formed with and cantilevered from the distal end of the front arm 62 is a lug member 66 extending over and above the plate member 44 and engageable with the slot 46 of the plate member 44, when the pedal side crank 58 is in the locking position, to keep the boom pedal 26 locked in the neutral position. As the pedal side crank 58 rotates into the unlocking position, the lug member 66 is disengaged from the slot 46 of the plate member 44, permitting the boom pedal 26 to rotate out of the neutral position into the first or second operative position. The length of the lug member 66 is such that it can positively engage with the slot 46 of the plate member 44 but does not protrude over the boom pedal 26 which would otherwise hinder the operator's actuation of the boom pedal 26.

The pedal side crank 58 is normally biased into the locking position by a tension spring 68, the one end of which is secured to the rear arm 64 of the pedal side crank 58 and the other end of which is anchored to the bracket 54 which in turn remains affixed to the side frame 12 of the vehicle body 10. The tension spring 68 gives the pedal side crank 58 a tendency to rotate into the locking position. If desired, the tension spring 68 may be substituted by other type of biasing means such as a torsion spring.

Referring collectively to FIGS. 1 through 3, it can be seen that a seat bar side crank 70 is attached to the side frame 12 at a position distant from the pedal side crank 58 for rotation about a pivot shaft 72. As with the pedal side crank 58, the seat bar side crank 70 is provided with a collar 74 rotatably fitted to the pivot shaft 72 and front and rear arms 76, 78 extending radially outwardly from the collar 74 in a spaced apart, e.g., 90 degree, relationship with each other. The seat bar side crank 70 of such configuration can be rotated between a forward position corresponding to the locking position of the pedal side crank 58 and a rearward position corresponding to the unlocking position of the pedal side crank 58. The front arm 76 of the seat bar side crank 70 is operatively associated with the rear arm 64 of the pedal side crank 58 by way of a connecting rod 80. In other words, the front arm 76 of the seat bar side crank 70 is connected to the rear end of the connecting rod 80 via a hinge pin 82, whereas the rear arm 64 of the pedal side crank 58 is coupled to the front end of the connecting rod 80 via a hinge pin 84. This enables the pedal side crank 58 to be interlocked with the seat bar side crank 70, assuring that any movement of one of the cranks 58 or 70 leads to the corresponding movement of the other crank.

As best shown in FIG. 3, the seat bar 34 has a push bracket 86 and a cushion pad 88 attached to the puh bracket 86 for the purpose of shock absorption and noise reduction. The push bracket 86 is adapted to depress the rear arm 78 of the seat bar side crank 70, when the seat bar 34 is swung into the lowered position as indicated in solid lines in FIG. 3, to thereby rotate the seat bar side crank 70 toward the rearward position. On the contrary, swinging movement of the seat bar 34 into the raised position will cause the push bracket 86 to be detached from the rear arm 78 of the seat bar side crank 70.

Operation of the pedal locking device 42 will now be set forth in detail. As the operator takes the seat 16 and brings the seat bar 34 into the lowered position as shown in solid lines in FIG. 1, the push bracket 86 of the seat bar 34 will eventually push the rear arm 78 of the seat bar side crank 70 in order to have the crank 70 rotated into the rearward position as illustrated in solid lines in FIG. 3. Such rotation of the seat bar side crank 70 is delivered to the pedal side crank 58 through the connecting rod 80, whereby the pedal side crank 58 rotates clockwise against the biasing force of the tension spring 68 to assume the pedal unlocking position. Thus the lug member 66 of the front arm 62 on the pedal side crank 58 is disengaged out of the slot 46 of the plate member 44, with a result that the boom pedal 26 becomes freely movable from the neutral position to the first or second operative position. Depressing the boom pedal 26 into the operative positions ensures that the hydraulic control valve 24 is so shifted as to permit fluid flow therethrough, thus causing the boom to be lifted up or lowered down at the operator's desire.

In the contrary event that the operator puts the seat bar 34 on the raised position as indicated in phantom lines in FIG.

1, the push bracket 86 of the seat bar 34 will move away from the rear arm 78 of the seat bar side crank 70. The pedal side crank 58 is then turned counterclockwise by the biasing force of the tension spring 68 to assume the locking position as shown in phantom lines in FIG. 3. At the same moment, the seat bar side crank 70 is caused to rotate into the forward position by the pulling force transmitted thereto via the connecting rod 80. As a consequence, the lug member 66 of the front arm 62 on the pedal side crank 58 comes into engagement with the slot 46 of the plate member 44 to thereby lock the boom pedal 26 in it's neutral position. The result is that the hydraulic valve unit 24 interrupts fluid flow therethrough to prevent any unwanted actuation of the boom.

Figure 5:
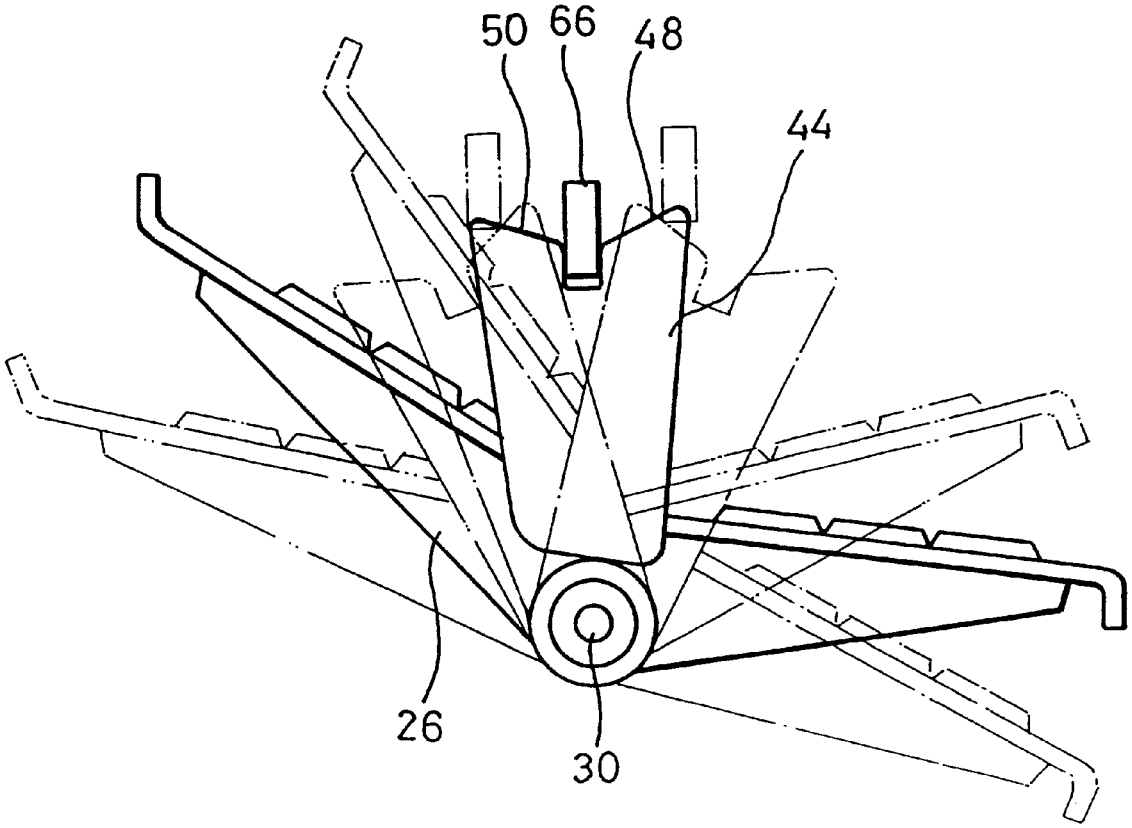
FIG. 5 shows the pedal forcibly brought into it's neutral position from various operative positions as the seat bar is lifted up.

In the meantime, if the seat bar 34 is forcibly lifted up by the operator while the boom pedal 26 is in the first operative position as illustrated in single dotted chain lines in FIG. 5, the lug member 66 of the pedal side crank 58 will depress the first ramp 48 of the plate member 44 attached to the boom pedal 26. Accordingly, the plate member 44 is forcedly rotated counterclockwise together with the boom pedal 26 to the position as shown in solid lines in FIG. 5 so that the lug member 66 can be eventually slid into the slot 46 of the plate member 44 to lock the boom pedal 26 in the neutral position. Such a forced returning of the boom pedal into the neutral position would also occur in case where the boom pedal 26 is in the second operative position as illustrated in double dotted chain lines in FIG. 5.

While the invention has been shown and described with reference to a preferred embodiment, it should be apparent to one of ordinary skill that many changes and modifications may be made without departing from the spirit and scope of the invention as defined in the claims.

What is claimed is:

1. A loader comprising:

a power operated working implement;

power delivery control means for selectively feeding and interrupting power to the working implement;

a seat bar swingable between a lowered position for securing the operator in place and a raised position for allowing the operator to enter or leave the loader;

a pedal operatively associated with the control means and movable between an operative position for causing the control means to feed the power to the working implement and a neutral position for having the control means interrupt the power delivery to the working implement, the pedal provided with first engaging means;

a pedal side crank provided adjacent the pedal for rotation between a locking position and an unlocking position, the pedal side crank having second engaging means releasably engageable with the first engaging means to keep the pedal in the neutral position while the pedal side crank remains in the locking position;

a seat bar side crank operatively connected to the pedal side crank for rotation between a forward position corresponding to the locking position of the pedal side crank and a rearward position corresponding to the unlocking position of the pedal side crank;

means for normally biasing the pedal side crank into the locking position; and a push bracket attached to the seat bar for directly pushing the seat bar side crank into the rearward position while the seat bar is in the lowered position.

2. The loader as recited in claim 1, wherein the first engaging means of the pedal comprises a plate member extending upwards from one side of the pedal and having a slot opened at it's top end.

3. The loader as recited in claim 2, wherein the plate member has first and second ramps diverging from the open end of the slot so that the height of the respective ramp gradually increases as the ramp goes away from the slot.

4. The loader as recited in claim 2, wherein the second engaging means comprises a lug member engageable with the slot of the plate member when the pedal side crank is rotated into the locking position.

5. The loader as recited in claim 1, wherein the means for normally biasing the pedal side crank comprises a tension spring connected to the pedal side crank to have it normally urged into the locking position.

6. A pedal locking device for a loader adapted to lock a pedal in its neutral position as a seat bar is swung from a lowered position into a raised position, comprising:

first engaging means movable in unison with the pedal;

a pedal side crank provided adjacent the pedal for rotation between a locking position and unlocking position;

second engaging means carried by the pedal side crank and releasably engageable with the first engaging means to keep the pedal in the neutral position while the pedal side crank remains in the locking position;

a seat bar side crank operatively connected to the pedal side crank for rotation between a forward position corresponding to the locking position of the pedal side crank and a rearward position corresponding to the unlocking position of the pedal side crank;

means for normally biasing the pedal side crank into the locking position; and a push bracket attached to the seat bar for directly pushing the seat bar side crank into the rearward position while the seat bar is in the lowered position.

7. The pedal locking device as recited in claim 6, wherein the first engaging means comprises a plate member extending upwards from one side of the pedal and having a slot opened at it's top end.

8. The pedal locking device as recited in claim 7, wherein the plate member has first and second ramps diverging from the open end of the slot so that the height of the respective ramp gradually increases as the ramp goes away from the slot.

9. The pedal locking device as recited in claim 7, wherein the second engaging means comprises a lug member engageable with the slot of the plate member when the pedal side crank is rotated into the locking position.

10. The pedal locking device as recited in claim 6, wherein the means for normally biasing the pedal side crank comprises a tension spring connected to the pedal side crank to have it normally urged into the locking position.

11. A loader comprising:

a power operated working implement;

a power delivery control arrangement to selectively feed and interrupt power to the working implement;

a seat bar swingable between a lowered position for securing the operator in place and a raised position for allowing the operator to enter or leave the loader;

a pedal operatively associated with the control arrangement and movable between an operative position for causing the control arrangement to feed the power to the working implement and a neutral position for having the control arrangement interrupt the power delivery to the working implement, the pedal provided with a first engaging mechanism;

a pedal side crank provided adjacent the pedal for rotation between a locking position and an unlocking position, the pedal side crank having a second engaging mechanism releasably engageable with the first engaging mechanism to keep the pedal in the neutral position while the pedal side crank remains in the locking position;

a seat bar side crank operatively connected to the pedal side crank for rotation between a forward position corresponding to the locking position of the pedal side crank and a rearward position corresponding to the unlocking position of the pedal side crank;

a biasing arrangement for normally biasing the pedal side crank into the locking position; and a push bracket attached to the seat bar for directly pushing the seat bar side crank into the rearward position while the seat bar is in the lowered position.

12. A pedal locking device for a loader adapted to lock a pedal in its neutral position as a seat bar is swung from a lowered position into a raised position, comprising:

a first engaging mechanism movable in unison with the pedal;

a pedal side crank provided adjacent the pedal for rotation between a locking position and unlocking position;

a second engaging mechanism carried by the pedal side crank and releasably engageable with the first engaging mechanism to keep the pedal in the neutral position while the pedal side crank remains in the locking position;

a seat bar side crank operatively connected to the pedal side crank for rotation between a forward position corresponding to the locking position of the pedal side crank and a rearward position corresponding to tile unlocking position of the pedal side crank;

a biasing arrangement for normally biasing the pedal side crank into the locking position; and a push bracket attached to the seat bar for directly pushing the seat bar side crank into the rearward position while the seat bar is in the lowered position.

* * * * *